US006271753B1

(12) United States Patent
Shukla

(10) Patent No.: US 6,271,753 B1
(45) Date of Patent: Aug. 7, 2001

(54) SMART LID

(76) Inventor: Kavita M Shukla, 10423 Popkins Ct., Woodstock, MD (US) 21163

( * ) Notice: Subject to any disclaimer, the term of this patent is extended or adjusted under 35 U.S.C. 154(b) by 0 days.

(21) Appl. No.: 09/531,878

(22) Filed: Mar. 21, 2000

(51) Int. Cl.[7] ..... G08B 13/08
(52) U.S. Cl. ..... 340/545.6; 340/571; 340/572.8
(58) Field of Search ..... 340/545.6, 572.7, 340/571, 572.8; 116/72, 99; 206/459, 807; 215/201

(56) References Cited

U.S. PATENT DOCUMENTS 3,611,333 * 10/1971 Conigliaro ..... 340/224
3,827,038 * 7/1974 Willis ..... 340/224
4,369,437 * 1/1983 Thampson, Jr. et al. ..... 340/539
4,847,597 * 7/1989 Dobosi et al. ..... 340/571
5,317,303 * 5/1994 Ross et al. ..... 340/539
5,382,945 * 1/1995 Novak ..... 340/569
5,625,347 * 4/1997 MacLean et al. ..... 340/686
5,710,551 * 1/1998 Ridgeway ..... 340/870.09
6,046,675 * 4/2000 Hanna ..... 340/569

* cited by examiner

*Primary Examiner*—Benjamin C. Lee
*Assistant Examiner*—Son Tang

(57) ABSTRACT

The invention comprises a lid or cover closing the top of a container or bottle, where the cover contains a built-in device that alerts the user when the container is opened or its content is leaking and will emit an alarm so that the user can respond and perform a subsequent action such as closing the container or bottle.

13 Claims, 4 Drawing Sheets

SMART LID

FIELD OF THE INVENTION

The invention described and claimed herein comprises a lid or cover closing the top of a container or receptacle, where said cover contains a built-in device that alerts the user when the container is opened and will emit an alarm so that the user can respond and perform a subsequent action such as closing the container or receptacle.

SUMMARY OF THE INVENTION

Bottles, containers and other receptacles containing hazardous or volatile materials, or materials which react with air, are used for different purposes in locations such as chemical and biochemical laboratories, industries and hospitals. At times, a user, such as a scientist, may fail to recap a bottle or container after use, resulting in the escape of hazardous materials such as gases or vapors into the atmosphere resulting in harm to the user and the environment. Often such gases can reach toxic levels when permitted to flow out of a container for an extended time period. Therefore, a device, which can alarm the user when a bottle or container is opened, can prevent the release of toxic substances into the environment and work settings such as a laboratory. Currently, there is no such device, which can warn a user, through an alarm system, that a bottle is open so that the user can perform an action to respond to the situation.

The invention described herein, is a low cost and simple warning device. The device may have following properties:

- It contains an alerting system based on emitting a light or sound alarm.
- It is easy to use and low cost.
- It comprises a universal system that can be used with any lid or cover for any bottle, container or receptacle.
- It can send a signal to a remote location through a wireless system, such that a user situated at a distance from the lid or cover can receive and respond to an emitted alarm signal.

The various features of novelty, which characterize the invention, are pointed out with particularity in the claims annexed to and forming a part of this disclosure. For a better understanding of the invention, its advantages and objects, reference is made to the accompanying drawings and descriptive matter in which a preferred embodiment of the invention is illustrated.

BRIEF DESCRIPTION OF THE DRAWINGS

The foregoing and still other objects of this invention will become apparent, along with various advantages and features of novelty residing in the present embodiments, from study of the following drawings, in which.

DESCRIPTION OF THE PREFERRED EMBODIMENT

Figure 1:
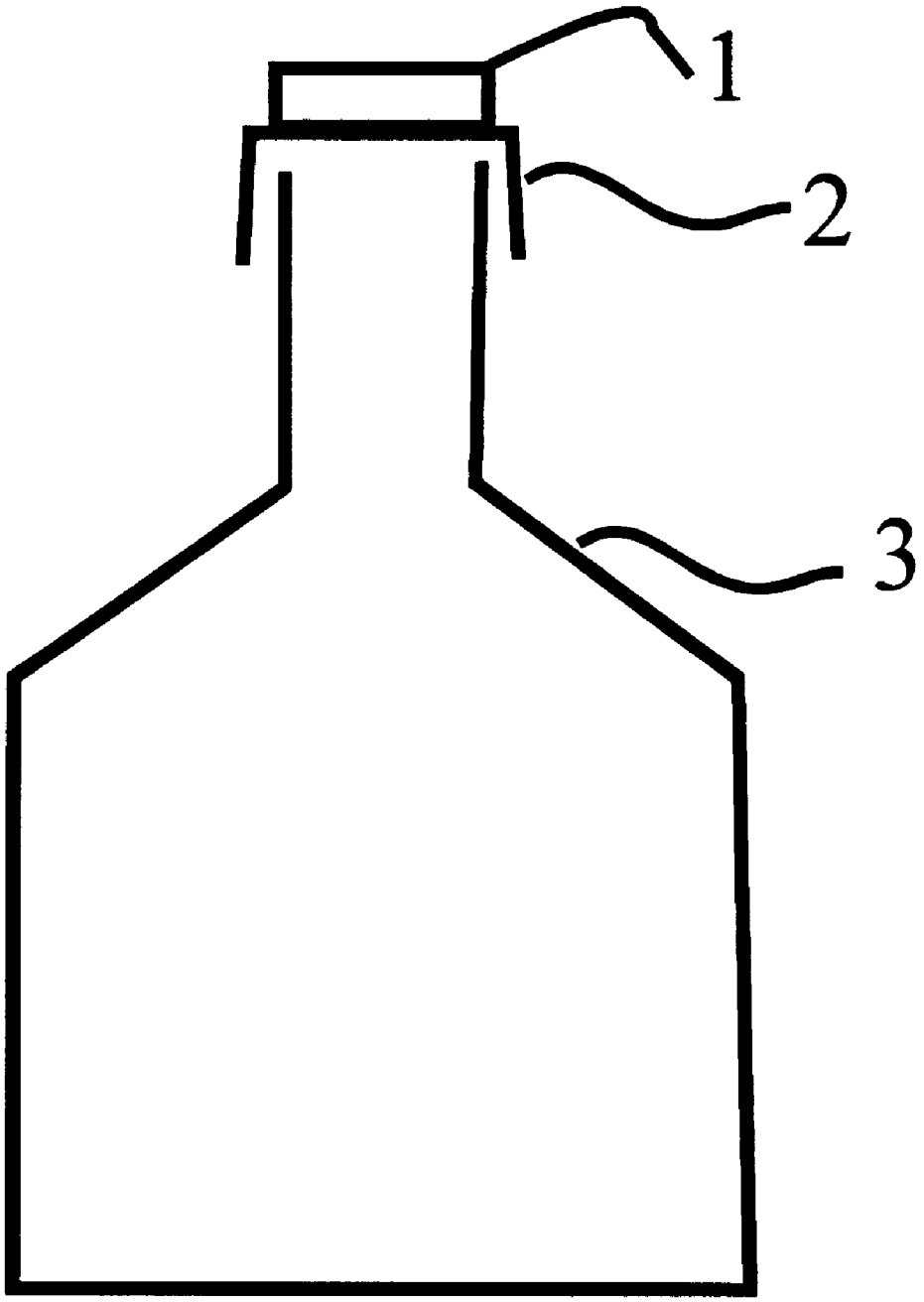
FIG. 1 is an expanded view of the lid or cover (2) containing an alarm system or warning device (1) which can be of any shape or size. The entire unit comprised of the cover (2) and alarm system (1) is placed on a bottle or container (3).
Figure 2:
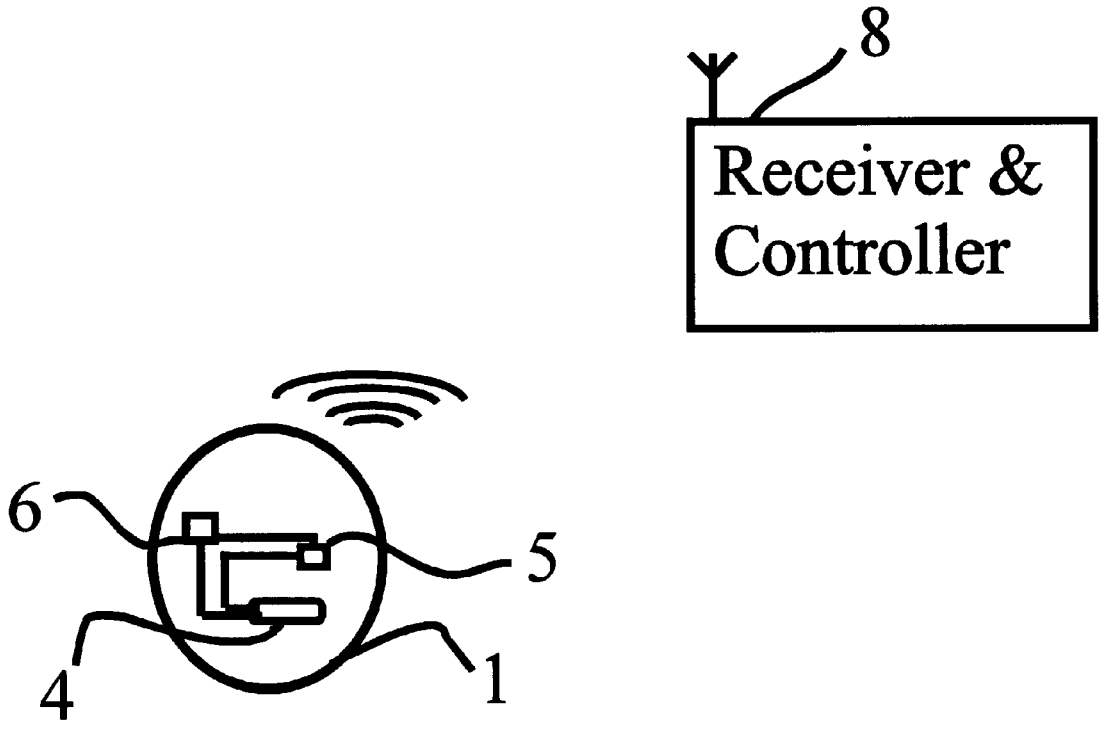
FIG. 2 is an expanded view of the warning device comprised of a switch (4), a battery or powering system (5) and an alarm unit (6). A receiver (8) is located at a remote location from the warning device.

Referring to the drawings, the invention is an alarm sensor (1) in the form of a flat strip or encapsulated in a case. The size of the device is such that it can be easily attached to the cover or lid (2) of a bottle, receptacle or container (3). The cover (2) may have the alarm system (1) either built-into the cover itself or attached to the cover through the use of any permanent or temporary adhesives or attachment systems, such as Velcro.

Once a user opens the lid or cover (2) the switch (4) in the alarm system (1) activates immediately, or after a predetermined period of time, resulting in the activation of the alarm system (6) and the transmission of a signal. The circuit can be powered by a battery (5). The signal source can be a light emitting diode (LED), which emits light to alert the user that the lid or cover has been removed from the aperture or opening of the container, bottle or receptacle. Other alerting systems can consist of, but are not limited to, frequency generators emitting infrared light, radio frequency, ultra sound, and sounds at 900 mega hertz ranges.

Furthermore, the alarm system (6) can be a wireless radio transmitter, which is activated as soon as the switch is turned on, when it closes the circuit. The alarm system then sends a signal to a wireless receiver (8). The receiver is activated when a signal from the lid/cover device (1) is received. The receiver can then transmit a sound, light or any other type of signal or alarm to alert the user to respond.

Figure 3:
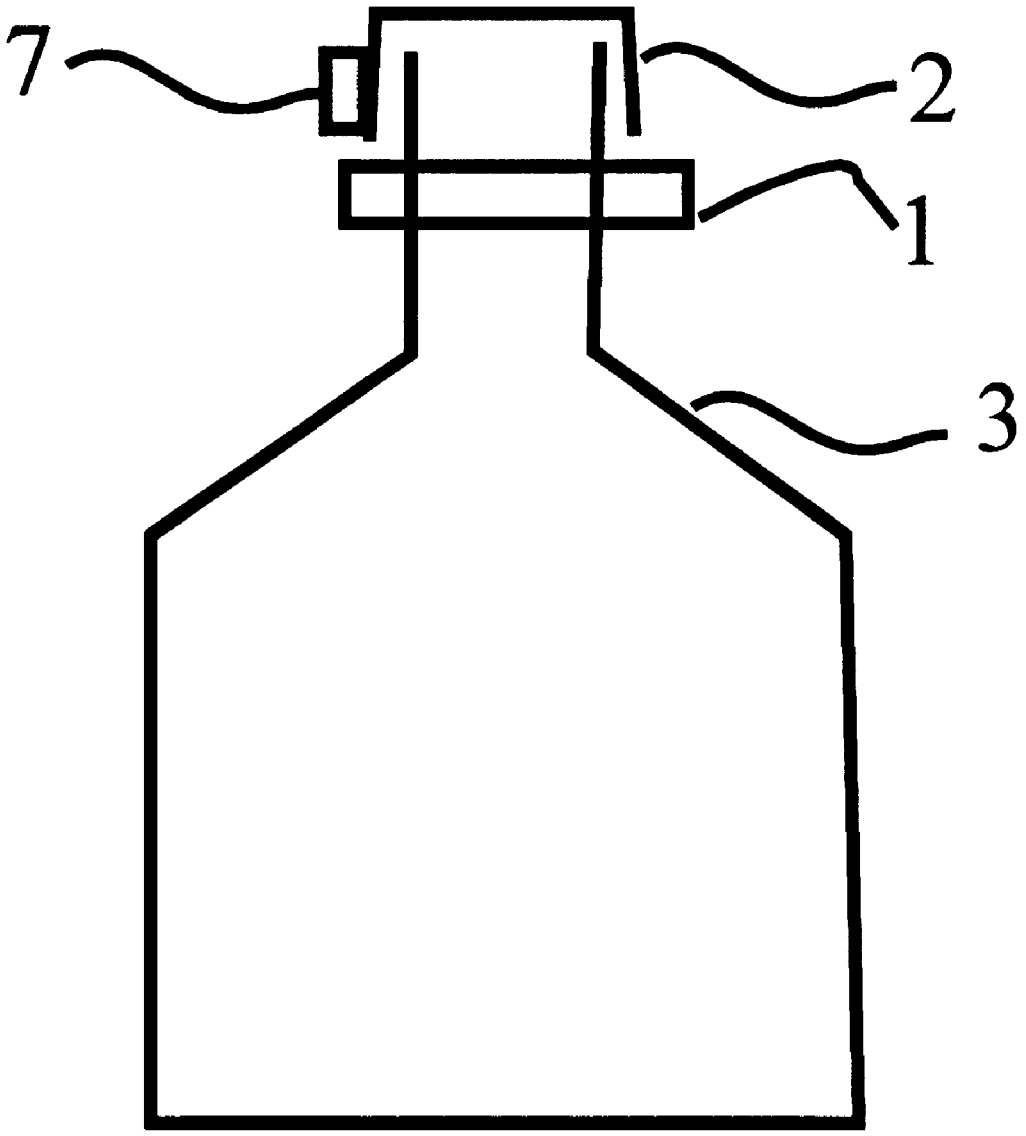
FIG. 3 shows a bottle or container (3) with a attachment containing the alarm system (1) and a switch (7) between the lid or cap (2) and the bottle or container (3).

In FIG. 3, a contact switch (7) is attached to the bottle (3). Said switch is activated, when the lid or cover (2) containing the alarm device (1) is removed from the bottle (3). In this case the alarm device is activated by a magnetic, contact switch or any other type of switch (7), which is attached to the lid or cover (2) attached to the bottle or container (3).

The device (1) can have a delay switch, so that the alarm (6) is activated after a time delay. This may be necessary because a user needs some time to perform a desired action with the opened bottle. After a certain time period has passed, the user may need to be reminded to close the bottle or container (3) so that toxic or other substances contained in the bottle (3) will not be released into the environment. Once the user closes the container (3) with the lid or cover (2), the alarm system (6) will reset will go into sleep mode until the container is opened again.

Figure 4:
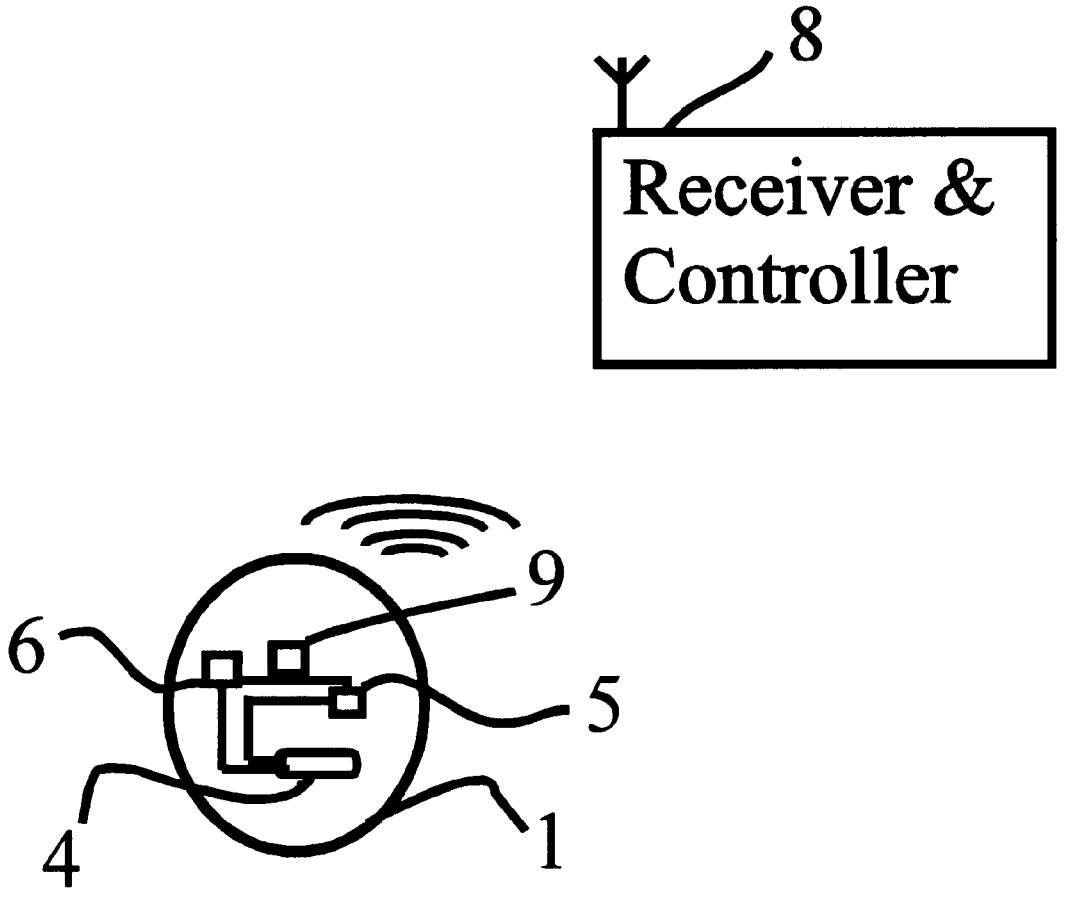
FIG. 4 shows many different types of sensors (10) comprising the alarm system (1) placed in or near a lid or cover.

Furthermore, other sensors (9) can be attached to the same circuit, as shown in FIG. 4, or in separate circuits with or without the alarm device (1). Such sensors (9) can be used to detect different physical and chemical properties such as temperature, concentration of gases, wetness levels and the presence of smoke. The sensors (9) can also be programmed so that they can send data to a receiver (8) from time to time. Such a receiver (9), which may be wireless, can be located at a remote location so that a user can receive signals at different locations relative to the lid or cover (2) and the bottle or container (3).

The switch (4) may be a tilt switch such as a mercury switch, a level sensor or any other type of switch. Furthermore a magnetic switch, a Hall effect switch or a light switch can be used to activate the alarm. The switch (7), as shown in FIG. 3, may be a contact switch, a Hall effect switch, a magnetic switch, an optical switch or any other type of switch.

The alarm device (6) can be, but is not limited to, an inductive coil or a frequency transponder with a switch but without a battery. The activation energy for the transponder or inductive coil can be received from a receiver or an outside source.

The broader usefulness of the invention may be illustrated by the following examples.

EXAMPLE 1

Use of an Alarm-emitting Device as an Attachment to the Cover of a Bottle Containing Liquid Bromine.

An alarm-emitting device is attached to the cover of a bottle containing liquid Bromine. The device is attached with Velcro or some other type of adhesive. When the cover is removed, the device emits an alarm, either immediately or after a predetermined period of time. This alerts the user that the hazardous bottle is open. The user can then respond by closing the lid or cover, preventing the release of Bromine vapors into the laboratory air or environment.

EXAMPLE 2

Use of an Alarm-emitting Device in the Cover or Lid of the Gasoline Tank of an Automobile An auto driver needs to open the cover to the gasoline tank and remove the lid from the opening of the tank to fill gasoline into an automobile. After such an action is performed the driver may forget to screw the lid or cap to the tank back into its position. If a alarm device were built into or attached to the gasoline tank lid, such a device would emit a signal after a predetermined time period preventing the driver from forgetting to screw the lid back onto the gasoline tank. The alarming system used for this purpose could be local or wireless and consist of any type of signal such as light or sound.

While a specific embodiment of the invention has been shown and described in detail to illustrate the application of the principles of the invention, it is understood that the invention may be embodied otherwise without departing from such principles and that various modifications, alternate constructions, and equivalents will occur to those skilled in the area given the benefit of this disclosure and the embodiment described herein, as defined by the appended claims.

What is claimed is:

1. An alarm cap used as a cover for covering the opening of a container or bottle comprising, a device assembly having a switch for detecting removal of said cap from said container or bottle, a sensor for sensing escaping of the content of said container or bottle into the external environment, and an alarm device that transmits a signal to a remote location when either said switch or said sensor is activated.

2. An alarm cap as in claim 1, further including a receiver at said remote location for receiving said transmitted signal.

3. An alarm cap as in claim 1 or 2, where said alarm device is comprised of circuitry for activating an alarm when said cover is removed from said container or bottle.

4. An alarm cap as in claim 3, wherein said switch is selected from at least one of a group consisting of a tilt switch, magnetic switch, light switch and level switch.

5. An alarm cap as in claim 1 or 2, where said device assembly is attached to said cap either permanently or temporarily.

6. An alarm cap as in claim 1 or 2, where said device assembly is attached to said cover such that said device assembly is removable for placement on a different cover.

7. An alarm cap as in claim 1 or 2, wherein said alarm device comprises a frequency generator.

8. An alarm cap as in claim 7, wherein said frequency generator is selected from at least one of a group consisting of light, infrared light, radio frequency, ultra sound, sound and 900 mega hertz range generator.

9. An alarm cap as in claim 1 or 2, where said sensor is selected from at least one of a group consisting of smoke detectors, wetness sensors, gas sensors and temperature sensors.

10. An alarm cap as in claim 1 or 2, where said signal is transmitted wirelessly to a receiver.

11. An alarm cap as in claim 10, where said receiver is capable of being positioned at any location and where said receiver is able to transmit a signal or perform an action.

12. An alarm cap as in claim 1 or 2, where said alarm device contains a frequency transponder without a battery to transmit said signal to said receiver.

13. An alarm cap as in claim 1 or 2, where said alarm device contains an inductive coil without a battery to transmit said signal to said receiver.

* * * * *